US008646531B2

(12) United States Patent
King et al.

(10) Patent No.: US 8,646,531 B2
(45) Date of Patent: Feb. 11, 2014

(54) TUBULAR ACTUATOR, SYSTEM AND METHOD

(75) Inventors: James G. King, Kingwood, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 302 days.

(21) Appl. No.: 12/608,399

(22) Filed: Oct. 29, 2009

(65) Prior Publication Data

US 2011/0100647 A1 May 5, 2011

(51) Int. Cl.
*E21B 34/00* (2006.01)

(52) U.S. Cl.
USPC ..... 166/318; 166/332.8

(58) Field of Classification Search
USPC ..... 166/318, 332.8, 193, 194
See application file for complete search history.

(56) References Cited

U.S. PATENT DOCUMENTS

| | | | |
|---|---|---|---|
| 1,883,071 | A | 12/1928 | Stone |
| 2,769,454 | A | 11/1956 | Bletcher et al. |
| 2,812,717 | A | 11/1957 | Brown |
| 2,822,757 | A | 2/1958 | Colberly |
| 2,973,006 | A | 2/1961 | Nelson |
| 3,007,527 | A | 11/1961 | Nelson |
| 3,013,612 | A | 12/1961 | Angel |
| 3,148,731 | A | 9/1964 | Holden |
| 3,211,232 | A | 10/1965 | Grimmer |
| 3,263,752 | A | 8/1966 | Conrad |
| 3,358,771 | A | 12/1967 | Berryman |
| 3,510,103 | A | 5/1970 | Carsello |
| 3,566,964 | A | 3/1971 | Livingston |
| 3,583,714 | A | 6/1971 | Weltzer et al. |
| 3,599,998 | A | 8/1971 | Kiwalle et al. |
| 3,667,505 | A | 6/1972 | Radig |
| 3,669,462 | A | 6/1972 | Parsons |
| 3,703,104 | A | 11/1972 | Tamplen |
| 3,727,635 | A | 4/1973 | Todd |
| 3,797,255 | A | 3/1974 | Kammerer, Jr. et al. |
| 3,901,315 | A | 8/1975 | Parker et al. |
| 3,954,138 | A | 5/1976 | Miffre |
| 3,997,003 | A | 12/1976 | Adkins |
| 4,067,358 | A | 1/1978 | Streich |
| 4,160,478 | A | 7/1979 | Calhoun et al. |

(Continued)

FOREIGN PATENT DOCUMENTS

| | | |
|---|---|---|
| CA | 2760107 | 11/2010 |
| EP | 0427422 A2 | 5/1991 |
| GB | 2281924 | 3/1995 |
| WO | 00/15943 | 3/2000 |

OTHER PUBLICATIONS

Notification of Transmittal of the International Search Report and the Written Opinion of the International Searching Authority; PCT/US2010/044856; Mailed Apr. 15, 2011.

(Continued)

*Primary Examiner* — Giovanna Wright
*Assistant Examiner* — Kipp Wallace
(74) *Attorney, Agent, or Firm* — Cantor Colburn LLP

(57) ABSTRACT

A tubular actuating system includes a tubular, a plurality of same plugs runnable within the tubular, an actuator disposed within the tubular, and a seatable member disposed at the actuator configured to be respositionable relative to the actuator between an unseated position and a seated position upon passage of at least one of the plurality of same plugs.

20 Claims, 2 Drawing Sheets

(56) References Cited

U.S. PATENT DOCUMENTS

| | | | | |
|---|---|---|---|---|
| 4,176,717 | A | 12/1979 | Hix | |
| 4,190,239 | A | 2/1980 | Schwankhart | |
| 4,246,968 | A | 1/1981 | Jessup et al. | |
| 4,260,017 | A | 4/1981 | Nelson et al. | |
| 4,291,722 | A | 9/1981 | Churchman | |
| 4,292,988 | A * | 10/1981 | Montgomery | 137/68.17 |
| 4,355,685 | A | 10/1982 | Beck | |
| 4,390,065 | A | 6/1983 | Richardson | |
| 4,448,216 | A | 5/1984 | Speegle et al. | |
| 4,474,241 | A | 10/1984 | Freeman | |
| 4,478,279 | A | 10/1984 | Puntar et al. | |
| 4,537,383 | A | 8/1985 | Fredd | |
| 4,554,981 | A | 11/1985 | Davies | |
| 4,566,541 | A * | 1/1986 | Moussy et al. | 166/318 |
| 4,576,234 | A | 3/1986 | Upchurch | |
| 4,583,593 | A | 4/1986 | Zunkel et al. | |
| 4,669,538 | A | 6/1987 | Szarka | |
| 4,711,326 | A | 12/1987 | Baugh et al. | |
| 4,714,116 | A | 12/1987 | Brunner | |
| 4,729,432 | A | 3/1988 | Helms | |
| 4,762,447 | A | 8/1988 | Marantette | |
| 4,823,882 | A | 4/1989 | Stokley et al. | |
| 4,826,135 | A | 5/1989 | Mielke | |
| 4,856,591 | A | 8/1989 | Donovan et al. | |
| 4,893,678 | A | 1/1990 | Stokley et al. | |
| 4,944,379 | A | 7/1990 | Haaser | |
| 4,979,561 | A | 12/1990 | Szarka | |
| 5,029,643 | A | 7/1991 | Winslow et al. | |
| 5,056,599 | A | 10/1991 | Comeaux et al. | |
| 5,230,390 | A | 7/1993 | Zastresek et al. | |
| 5,244,044 | A | 9/1993 | Henderson | |
| 5,297,580 | A | 3/1994 | Thurman | |
| 5,305,837 | A | 4/1994 | Johns et al. | |
| 5,335,727 | A | 8/1994 | Cornette et al. | |
| 5,343,946 | A | 9/1994 | Morrill | |
| 5,398,947 | A | 3/1995 | Cook | |
| 5,529,126 | A | 6/1996 | Edwards | |
| 5,609,178 | A | 3/1997 | Hennig et al. | |
| 5,704,393 | A | 1/1998 | Connell et al. | |
| 5,762,142 | A | 6/1998 | Connell et al. | |
| 5,775,421 | A | 7/1998 | Duhon et al. | |
| 5,775,428 | A | 7/1998 | Davis et al. | |
| 5,813,483 | A | 9/1998 | Latham et al. | |
| 5,960,881 | A | 10/1999 | Allamon et al. | |
| 6,050,340 | A | 4/2000 | Scott | |
| 6,053,250 | A | 4/2000 | Echols | |
| 6,079,496 | A | 6/2000 | Hirth | |
| 6,102,060 | A | 8/2000 | Howlett et al. | |
| 6,155,350 | A | 12/2000 | Melenyzer | |
| 6,173,795 | B1 | 1/2001 | McGarian et al. | |
| 6,220,350 | B1 | 4/2001 | Brothers et al. | |
| 6,227,298 | B1 | 5/2001 | Patel | |
| 6,253,861 | B1 | 7/2001 | Carmichael et al. | |
| 6,293,517 | B1 | 9/2001 | Cunningham | |
| 6,378,609 | B1 | 4/2002 | Oneal et al. | |
| 6,474,412 | B2 | 11/2002 | Hamilton et al. | |
| 6,530,574 | B1 | 3/2003 | Bailey et al. | |
| 6,547,007 | B2 | 4/2003 | Szarka et al. | |
| 6,634,428 | B2 | 10/2003 | Krauss et al. | |
| 6,644,412 | B2 | 11/2003 | Bode et al. | |
| 6,666,273 | B2 | 12/2003 | Laurel | |
| 6,668,933 | B2 | 12/2003 | Kent | |
| 6,681,860 | B1 | 1/2004 | Yokley et al. | |
| 6,712,145 | B2 | 3/2004 | Allamon | |
| 6,712,415 | B1 | 3/2004 | Darbishire et al. | |
| 6,834,726 | B2 | 12/2004 | Giroux et al. | |
| 6,866,100 | B2 | 3/2005 | Gudmestad et al. | |
| 6,896,049 | B2 | 5/2005 | Moyes | |
| 6,948,561 | B2 | 9/2005 | Myron | |
| 6,983,795 | B2 | 1/2006 | Zuklic et al. | |
| 7,150,326 | B2 | 12/2006 | Bishop et al. | |
| 7,322,408 | B2 | 1/2008 | Howlett | |
| 7,325,617 | B2 | 2/2008 | Murray | |
| 7,337,847 | B2 | 3/2008 | McGarian et al. | |
| 7,350,578 | B2 | 4/2008 | Szarka et al. | |
| 7,377,321 | B2 | 5/2008 | Rytlewski | |
| 7,387,165 | B2 | 6/2008 | Lopez de Cardenas et al. | |
| 7,416,029 | B2 | 8/2008 | Telfer et al. | |
| 7,467,664 | B2 | 12/2008 | Cochran et al. | |
| 7,503,390 | B2 | 3/2009 | Gomez | |
| 7,503,392 | B2 | 3/2009 | King et al. | |
| 7,520,336 | B2 | 4/2009 | Mondelli et al. | |
| 7,730,953 | B2 | 6/2010 | Casciaro | |
| 7,832,472 | B2 | 11/2010 | Themig | |
| 7,971,883 | B2 | 7/2011 | Soroka et al. | |
| 2001/0007284 | A1 | 7/2001 | French et al. | |
| 2004/0007365 | A1 | 1/2004 | Hill et al. | |
| 2005/0061372 | A1 | 3/2005 | McGrath et al. | |
| 2005/0072572 | A1 | 4/2005 | Churchill | |
| 2005/0126638 | A1 | 6/2005 | Gilbert | |
| 2005/0205264 | A1 | 9/2005 | Starr et al. | |
| 2006/0124310 | A1 | 6/2006 | Lopez de Cardenas et al. | |
| 2006/0169463 | A1 | 8/2006 | Howlett | |
| 2006/0175092 | A1 | 8/2006 | Mashburn | |
| 2006/0213670 | A1 | 9/2006 | Bishop et al. | |
| 2006/0243455 | A1 | 11/2006 | Telfer et al. | |
| 2007/0007007 | A1 | 1/2007 | Themig et al. | |
| 2007/0012438 | A1 | 1/2007 | Hassel-Sorensen | |
| 2007/0023087 | A1 | 2/2007 | Krebs et al. | |
| 2007/0095538 | A1 | 5/2007 | Szarka et al. | |
| 2007/0272413 | A1 * | 11/2007 | Rytlewski et al. | 166/318 |
| 2008/0066924 | A1 | 3/2008 | Xu | |
| 2008/0093080 | A1 | 4/2008 | Palmer et al. | |
| 2008/0190620 | A1 | 8/2008 | Posevina et al. | |
| 2008/0217025 | A1 | 9/2008 | Ruddock et al. | |
| 2008/0308282 | A1 | 12/2008 | Standridge et al. | |
| 2009/0032255 | A1 | 2/2009 | Surjaatmadja et al. | |
| 2009/0044944 | A1 | 2/2009 | Murray et al. | |
| 2009/0044946 | A1 | 2/2009 | Schasteen et al. | |
| 2009/0044955 | A1 | 2/2009 | King et al. | |
| 2009/0056934 | A1 | 3/2009 | Xu | |
| 2009/0056952 | A1 * | 3/2009 | Churchill | 166/373 |
| 2009/0107680 | A1 | 4/2009 | Surjaatmadja | |
| 2009/0159289 | A1 | 6/2009 | Avant et al. | |
| 2009/0308588 | A1 | 12/2009 | Howell et al. | |
| 2010/0294514 | A1 | 11/2010 | Crow et al. | |
| 2011/0108284 | A1 | 5/2011 | Flores et al. | |
| 2011/0180274 | A1 | 7/2011 | Wang et al. | |

OTHER PUBLICATIONS

Notification of Transmittal of the International Search Report and the Written Opinion of the International Searching Authority; PCT/US2010/044383; Mailed Apr. 15, 2011.

International Search Report and Written Opinion; Date of Mailing Aug. 29, 2011; International Application No. PCT/US2011/022523; International Filing Date Jan. 26, 2011; Korean Intellectual Property Office; International Search Report 5 pages; Written Opinion 3 pages.

International Search Report and Written Opinion of the International Searching Authority; PCT/US2010/044378; Mailed Mar. 17, 2011.

International Search Report; PCT/US2010/033737; Korean Intellectual Property Office; Mailed Jan. 24, 2011.

International Search Report; Date of Mailing Jan. 24, 2011; International Appln No. PCT/US2010/034736; 3 Pages.

International Search Report; Date of Mailing Jan. 24, 2011; Internatiaonal Appln. No. PCT/US2010/034752; 3 Pages.

Nternational Search Report and Written Opinion; Date of Mailing Feb. 11, 2011; International Appln No. PCT/US2010/041049; International Search Report 5 Pages and Written Opinion 3 Pages.

International Search Report; PCT/US2010/044399; International Searching Authority KIPO; Mailed Mar. 21, 2011.

Notification of Transmittal of the International Search Report and the Written Opinion of the International Searching Authority; PCT/US2010/054487; International Searching Authority; KIPO; Mailed Jun. 3, 2011.

Notification of Transmittal of the International Search Report and the Written Opinion of the International Searching Authority; PCT/US2010/049810; International Searching Authority KIPO; Mailed Apr. 25, 2011.

Response to Office Action dated Oct. 15, 2008, in U.S. Appl. No. 11/891,713, U.S. Patent and Trademark Office, U.S.A.

(56) References Cited

OTHER PUBLICATIONS

Office Action dated Jun. 25, 2009, in U.S. Appl. No. 11/891,714, USPTO, U.S.A.
Office Action dated Jun. 19, 2009, in U.S. Appl. No. 11/891,715, U.S. Patent and Trademark Office, U.S.A.
Response to Restriction Requirement dated Apr. 22, 2009 in U.S. Appl. No. 11/891,715, U.S. Patent and Trademark Office, U.S.A.
Office Action dated Apr. 9, 2009, in U.S. Appl. No. 11/891,715, U.S. Patent and Trademark Office, U.S.A.
Notice of Allowance & Fees Due and Notice of Allowability dated Jan. 5, 2009, in U.S. Appl. No. 11/891,713, U.S. Patent and Trademark Office, U.S.A.
Office Action dated Jul. 16, 2008 in U.S. Appl. No. 11/891,713 U.S. Patent and Trademark Office, U.S.A.
International Search Report, Feb. 11, 2009 pp. 1-3, PCT/US20081072732, Korean Intellectual Property Office.
Notification of Transmittal of the International Search Report and the Written Opinion of the International Searching Authority, Or the Declaration, Feb. 11, 2009, pp. 1-4, PCT/US2008/072732, Korean Intellectual Property Office.
Notification of Transmittal of the International Search Report and the Written Opinion of the International Searching Authority, Or the Declaration, Feb. 11, 2009, pp. 1-4, PCT/US2008/072734, Korean Intellectual Property Office.
Written Opinion of the International Searching Authority, Feb. 11, 2009, pp. 1-3, PCT/US2008/072732, Korean Intellectual Property Office.
Written Opinion of the International Searching Authority, Feb. 11, 2009, pp. 1-4, PCT/US2008/072734, Korean Intellectual Property Office.
International Search Report, Feb. 11, 2009, pp. 1-3, PCT/US2008/072734, Korean Intellectual Property Office.
International Search Report, Feb. 11, 2009, pp. 1-3, PCT1US2008/072735, Korean Intellectual Property Office.
Notification of Transmittal of the International Search Report and the Written Opinion of the International Searching Authority, Or the Declaration, Feb. 11, 2009, pp. 1-4, PCT/US2008/072735, Korean Intellectual Property Office.
Notification of Transmittal of the International Search Report and the Written Opinion of the International Searching Authority, or the Declaration, Jan. 19, 2009, pp. 1-4, PCT/US20081072470, Korean Intellectual Property Office.
Written Opinion of the International Searching Authority, Feb. 11, 2009, pp. 1-4, PCT/US2008/072735, Korean Intellectual Property Office.
Written Opinion of the International Searching Authority, Jan. 19, 2009, pp. 1-3, PCT/US2008/072470, Korean Intellectual Property Office.
International Search Report, Jan. 19, 2009, pp. 1-3, PCT/US2008/072470, Korean Intellectual Property Office.
Baker Hughes, Baker Oil Tools, Conventional Fishing Technical Unit; Pump Out Sub Product Family No. H14061, Jun. 7, 2005, 1 page.
Ross, C. M., et al., "Current Materials and Devices for Control of Fluid Loss," SPE 54323, Apr. 1999, pp. 1-16.
Hoffman, C.R., "One-Trip Sand-Control/Liner Hangar/ Big-Bore Completion System," SPE 101086, Sep. 2006, pp. 1-10.
G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.
Boscan, J. et al., "Successful Well Testing Operations in High-Pressure/High-Temperature Encironment; Case Histories," SPE 84096, Oct. 2003, pp. 1-15.
Brad Musgrove, Multi-Layer Fracturing Solution Treat and Produce Completions, Nov. 12, 2007, pp. 1-23, Schlumberger, U.S.A.
RFID Keystone Module, RFID & Intelligent Products, Petrowell retrieved online on May 27, 2009 from: http://www.petrowell.co.uk/index2.php?option=com_docman&task=doc_view&gid=15&Itemid=26.
StageFRAC Maximize Reservoir Drainage, 2007, pp. 1-2, Schlumberger, U.S.A.
TAP Completion System, Schlumberger, 4 pages, Dec. 2007.
Notification of Transmittal of the International Search Report and the Written Opinion of the International Searching Authority; PCT/US2011/041663; Korean Intellectual Property Office; Mailed Dec. 14, 2011; 8 pages.

* cited by examiner

TUBULAR ACTUATOR, SYSTEM AND METHOD

BACKGROUND

Tubular system operators are always receptive to new methods and devices to permit actuation of tubular tools such as those in industries concerned with earth formation boreholes, such as hydrocarbon recovery and gas sequestration, for example. It is not uncommon for various operations in these industries to utilize a temporary or permanent plugging device against which to build pressure to cause an actuation.

Sometimes actuating is desirable at a first location, and subsequently at a second location. Moreover, additional actuating locations may also be desired and the actuation can be sequential for the locations or otherwise. Systems employing droppable members, such as balls, for example, are typically used for just such purpose. The ball is dropped to a ball seat positioned at the desired location within the borehole thereby creating the desired plug to facilitate the actuation.

In applications where the first location is further from surface than the second location, it is common to employ seats with sequentially smaller diameters at locations further from the surface. Dropping balls having sequentially larger diameters allows the ball seat furthest from surface to be plugged first (by a ball whose diameter is complementary to that seat), followed by the ball seat second furthest from surface (by a ball whose diameter is complementary to that seat) and so on.

The foregoing system, however, creates increasingly restrictive dimensions within the borehole that can negatively impact flow therethrough as well as limit the size of tools that can be run into the borehole. Additionally, the number of discrete ball/seat combinations that can be run is limited as a result of the increasingly restrictive dimensions. Systems and methods that allow operators to increase the number of actuatable locations within a borehole without the drawbacks mentioned would be well received in the art.

BRIEF DESCRIPTION

Disclosed herein is a tubular actuating system. The system includes, a tubular, a plurality of same plugs runnable within the tubular, an actuator disposed within the tubular, and a seatable member disposed at the actuator configured to be respositionable relative to the actuator between an unseated position and a seated position upon passage of at least one of the plurality of same plugs.

Further disclosed herein is a method of actuating a tubular actuator. The method includes, running a runnable member within a tubular, contacting the tubular actuator with the runnable member, repositioning a seatable member, seating the seatable member, and pressuring up against the seated seatable member to actuate the tubular actuator.

Further disclosed herein is a tubular actuator. The actuator includes, a body disposable within a tubular being movable relative to the tubular, and a member being repositionable relative to the body from an unseated position to a seated position upon passage of at least one runnable member thereby.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
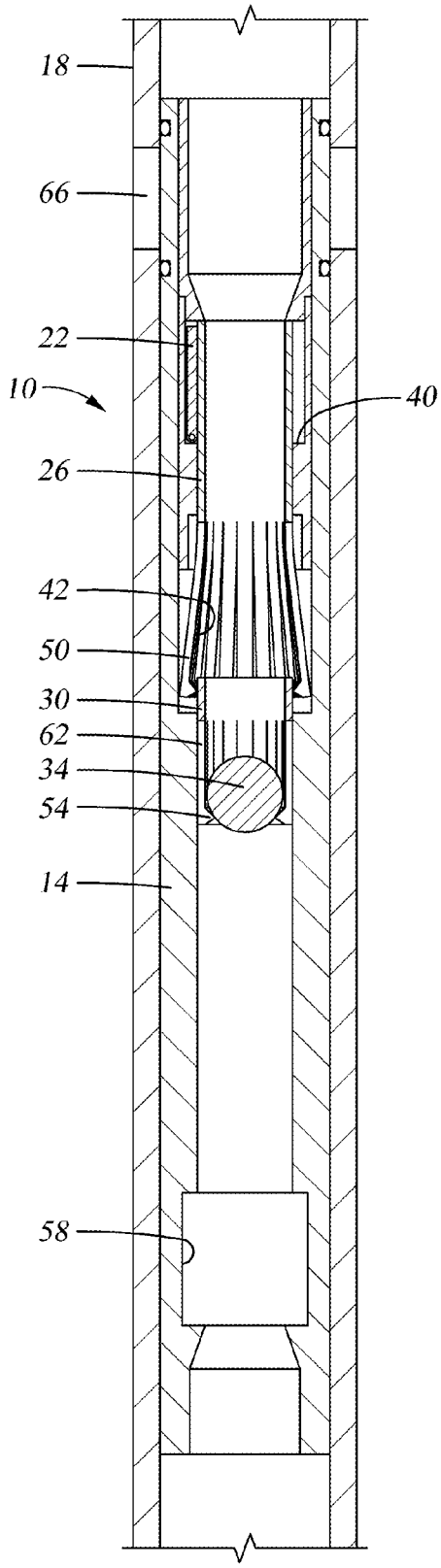
FIG. 1 depicts a partial cross sectional view of a tubular actuator disclosed herein being contacted with a runnable member.
Figure 2:
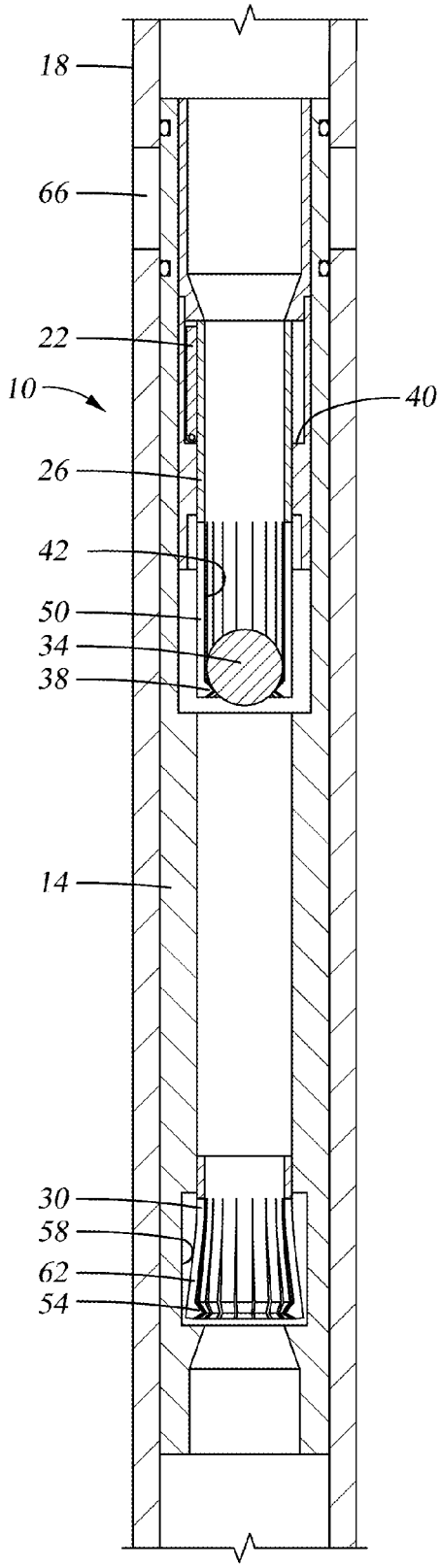
FIG. 2 depicts a partial cross sectional view of the tubular actuator of FIG. 1 shown being contacted with another runnable member.
Figure 3:
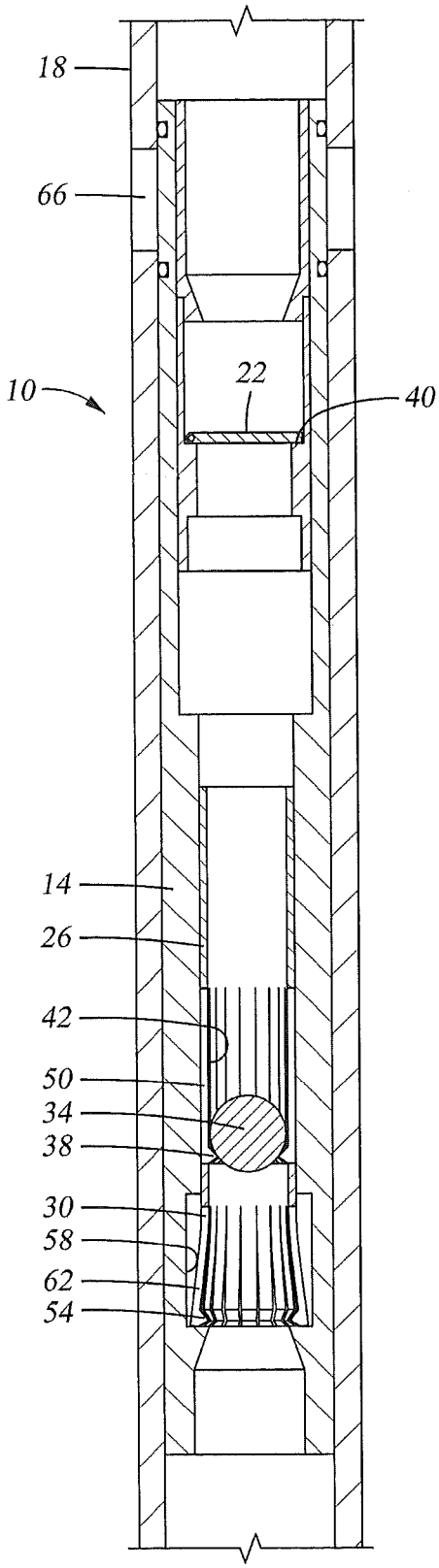
FIG. 3 depicts a partial cross sectional view of the tubular actuator of FIG. 1 shown with a seatable member in a seated position.

Referring to FIGS. 1-3, an embodiment of a tubular actuator disclosed herein is illustrated generally at 10. The tubular actuator 10 includes, a body 14, having a tubular shape, disposed within a tubular 18, a seatable member 22, illustrated in this embodiment as a flapper, a sleeve 26, and an optional collar 30. The flapper 22, the sleeve 26 and the collar 30 are all repositionable relative to the body 14 in response to contact of the actuator 10 with runnable members 34, also referred to herein as plugs or balls, which are runnable within the tubular 18. The sleeve 26, in this embodiment, is originally positioned in longitudinal alignment with and radially inwardly of the flapper 22. This initial position of the sleeve 26 maintains the flapper 22 in an open position, as shown in FIGS. 1 and 2.

The sleeve 26 has a profile 38 on an inner radial surface 42 engagably receptive to the balls 34, as best shown in FIG. 2. Pressure applied against the ball 34, when engaged with the profile 38, can urge the sleeve 26 to reposition to a downstream position as shown in FIG. 3. When in the downstream position the sleeve 26 is no longer longitudinally aligned with the flapper 22, thereby allowing the flapper 22 to reposition from the open position to a closed position wherein the flapper 22 is seatingly engaged with a seat 46 on the body 14. A biasing member 40, illustrated herein as a torsional spring can rotationally bias the flapper 22 toward the closed position. When the flapper 22 is seatingly engaged with the seat 46 any pressure increases upstream of the flapper 22 will increase forces applied to the actuator 10 thereby urging actuation thereof.

The optional collar 30, if the actuator 10 is so equipped (as the one illustrated herein is), longitudinally overlaps the profile 38 of the sleeve 26 in its original position. This overlapping positioning holds collet fingers 50, of the sleeve 26, in a radially expanded position, as shown in FIG. 1. Since the profile 38 is on the radially expanded portion of the sleeve 26, the ball 34 is able to pass thereby without engaging the profile 38. A profile 54 on the collar 30, also engagable with the balls 34, allows pressure applied against a ball 34 seated therewith to reposition the collar 30 to a downstream position as shown in FIGS. 2 and 3. Once the collar 30 is disengaged from the overlapping position with the sleeve 26 the profile 38 is able to return to an unexpanded position wherein it is engagable with the balls 34. An annular recess 58 in the body 14 is receptive to radially expanded collet fingers 62 of the collar 30 such that the ball 34 is able to pass thereby.

The foregoing construction allows an operator to run a ball 34 within the tubular 18 until it engages with the profile 54. Pressuring up against the engaged ball 34 allows the sleeve to be moved downstream until the collet fingers 62 expand into the annular recess 58 thereby allowing the ball 34 to pass through the collar 30, possibly to be used to actuate another tool located downstream thereof. The downstream movement of the collar 30, in relation to the sleeve 26, releases the collet fingers 50 thereby configuring the profile 38 to engage the next ball 34 to be run thereagainst. Pressure built upstream of the second ball 34 engaged with the profile 38 causes the sleeve 26 to move downstream thereby releasing the flapper 22 allowing the flapper 22 to move from the open position to the closed position. Once closed, the flapper 22, being seated against the seat 46, allows pressure to build upstream thereof to allow actuation of the actuator 10. Such actuation may be used to open ports 66 through the tubular 18, for example, to allow fluid treating such as fracturing or acidizing of a formation within which the tubular 18 is positioned, in the case of an application involved in the hydrocarbon recovery industry.

By allowing one or more of the balls 34 to pass, prior to the closing of the flapper 22 and subsequent actuation of the actuator 10, the system employing a plurality of the actuators 10 and/or other conventional actuators that actuate, for example, upon engagement with a first of the balls 34, can increase the number of actuatable zones with balls 34 of a particular size. This system alleviates the concerns associated with conventional systems that incorporate a plurality of actuators, each with smaller dimensions than the last, to permit actuation with balls of ever decreasing size. Some concerns being the decrease in production flows due to the smaller flow areas created by the smaller dimensions, and restrictions on the size of tools that can be employed during intervention due to the smaller dimensions. Additionally, the increased number of actuators can be employed to open an increased number of ports such as the ports 66, thereby increasing a number of zones that can be fractured or treated for a given well.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A tubular actuating system, comprising:

a tubular;

a plurality of same plugs runnable within the tubular;

an actuator disposed within the tubular; and a flapper disposed at the actuator configured to be repositionable relative to the actuator between an unseated position and a seated position upon passage of a second of the plurality of same plugs but not upon passage of a first of the plurality of same plugs, the actuator being configured to be directly modified to engage the second of the plurality of same plugs in response to engagement of the first of the plurality of same plugs with the actuator and passage of the first of the plurality of same plugs from a first end of the actuator to a second end of the actuator, the tubular actuator being configured to actuate in response to pressure built against the flapper in a same direction as the plugs were run.

2. The tubular actuating system of claim 1, wherein the plurality of same plugs are balls.

3. The tubular actuating system of claim 1, further comprising a sleeve in operable communication with the flapper and the actuator such that the sleeve prevents repositioning of the flapper until being moved by at least one of the plurality of same plugs.

4. The tubular actuating system of claim 3, wherein the sleeve is configured to be repositioned in response to contact by at least one of the plurality of same plugs.

5. The tubular actuating system of claim 3, further comprising a collar in operable communication with the sleeve configured to prevent repositioning of the sleeve until after the collar has been repositioned.

6. The tubular actuating system of claim 5, wherein the collar is configured to be repositioned in response to being moved by a first of the plurality of same plugs.

7. The tubular actuating system of claim 5, wherein the collar is configured to allow passage of a first of the plurality of same plugs after repositioning thereof.

8. The tubular actuating system of claim 7, wherein the actuator remains unactuated after passage of the first plug thereby allowing the first plug to actuate another device positioned within the tubular.

9. The tubular actuating system of claim 1, wherein the flapper is biased toward the seated position.

10. The tubular actuating system of claim 1, wherein the tubular includes at least one port therethrough openable by actuation of the actuator.

11. The tubular actuating system of claim 10, wherein the at least one port is configured to allow fracturing of a formation therethrough.

12. The tubular actuating system of claim 10, wherein the at least one port is configured to allow fluid treating of a formation therethrough.

13. A method of actuating a tubular actuator, comprising:

running a first runnable member within a tubular;

engaging the tubular actuator with the first runnable member;

passing the runnable member by the tubular actuator without seating a flapper;

directly altering the tubular actuator with the first runnable member to a configuration engagable by a second runnable member;

running a second runnable member dimensioned the same as the first runnable member within the tubular;

engaging the tubular actuator with the second runnable member, thereby repositioning the flapper;

seating the flapper; and pressuring up against the seated flapper in a same direction that the runnable members were run to actuate the tubular actuator.

14. The method of actuating a tubular actuator of claim 13, further comprising repositioning a sleeve relative to the tubular actuator with the runnable member.

15. The method of actuating a tubular actuator of claim 14, further comprising repositioning a collar relative to the tubular actuator with a first runnable member before repositioning the sleeve with a second runnable member.

16. The method of actuating a tubular actuator of claim 15, wherein the first runnable member and the second runnable member have substantially the same dimensions.

17. The method of actuating a tubular actuator of claim 15, wherein the collar prevents repositioning of the sleeve until the collar has been repositioned.

18. The method of actuating a tubular actuator of claim 13, further comprising passing a first runnable member by the tubular actuator.

19. A tubular actuator comprising:

a body disposable within a tubular being movable relative to the tubular;

a sleeve being movable relative to the body by a runnable member being engaged therewith; and a flapper being repositionable relative to the body from an unseated position to a seated position upon movement of the sleeve, the sleeve being directly alterable to be engagably movable by a second runnable member in direct response to engagement of a first runnable member with the tubular actuator and passage of the first runnable member from a first end of the tubular actuator to a second end of the tubular actuator, the tubular actuator being actuatable in response to pressure built against the seated flapper in a same direction as the runnable members were run.

20. The tubular actuator of claim 19, wherein the body is configured to move relative to the tubular in response to pressure applied against the flapper in the seated position.

* * * * *